US005865113A

United States Patent [19]

Weber

[11] Patent Number: 5,865,113

[45] Date of Patent: Feb. 2, 1999

[54] MATERIAL DENSIFYING AND SEPARATING DEVICE

[76] Inventor: Irvon Weber, R.R. #2, Elmira, Ontario, Canada, N3B 2Z2

[21] Appl. No.: 988,674

[22] Filed: Dec. 11, 1997

[51] Int. Cl.[6] ..... B30B 9/06

[52] U.S. Cl. ..... 100/43; 100/98 R; 100/128; 100/232

[58] Field of Search ..... 100/43, 98 R, 100/125–129, 232, 249, 250, 906, 269.11, 269.13

[56] References Cited

U.S. PATENT DOCUMENTS

| | | | |
|---|---|---|---|
| 254,575 | 3/1882 | Soule . | |
| 1,357,052 | 10/1920 | Henry | 100/128 |
| 1,366,307 | 1/1921 | ten Bosch . | |
| 1,445,314 | 2/1923 | Henry | 100/128 |
| 1,867,137 | 7/1932 | Carver | 100/127 |
| 1,974,697 | 9/1934 | ten Bosch Nizn | 100/128 |
| 1,990,839 | 2/1935 | Power | 100/128 |
| 3,451,185 | 6/1969 | Tezuka . | |
| 3,802,635 | 4/1974 | Drischel | 100/127 |
| 4,036,359 | 7/1977 | Strickland, Jr. . | |
| 4,230,733 | 10/1980 | Tilby . | |
| 4,287,823 | 9/1981 | Thompson . | |
| 4,343,233 | 8/1982 | Burgin . | |
| 4,448,537 | 5/1984 | Sugimori et al. | 100/128 |
| 4,536,920 | 8/1985 | Amersfoort . | |
| 4,538,324 | 9/1985 | Prosenbauer . | |
| 4,603,909 | 8/1986 | Le Jeune . | |
| 4,665,817 | 5/1987 | Simpson . | |
| 4,691,628 | 9/1987 | Simpson . | |
| 5,001,975 | 3/1991 | Finden | 100/232 |
| 5,100,064 | 3/1992 | Holzknecht . | |
| 5,146,848 | 9/1992 | Dufour . | |
| 5,230,917 | 7/1993 | Peters . | |
| 5,251,552 | 10/1993 | Gourdol | 100/127 |
| 5,352,469 | 10/1994 | Peters . | |

FOREIGN PATENT DOCUMENTS

| | | | |
|---|---|---|---|
| 885328 | 9/1943 | France | 100/128 |
| 2527139 | 11/1983 | France | 100/232 |

*Primary Examiner*—Stephen F. Gerrity

[57] ABSTRACT

The invention provides a novel device for separating a composite raw material under pressure into constituent flowable and residual materials. The device comprises: a laminated block having a longitudinal axis, the block comprising a plurality of transverse plates, each plate having: a first aligned bore defining an elongate collection chamber; a second aligned bore defining an elongate drain; and a transverse surface of each plate including a drainage channel extending between the first and second bores; an elongate perforated liner disposed within the collection chamber, the liner comprising a plurality of transverse planar bushings having an external surface bearing on an internal surface of the collection chamber, each bushing having: an internal aligned bore defining an elongate compression chamber; a groove in said external bushing surface defining a collection manifold between the collection chamber and each bushing; and a transverse surface of each bushing including a plurality of indentations extending between the internal bore and the collection manifold; input means for loading the compression chamber with said composite raw material; pressure means for pressurizing the raw material in the compression chamber urging said flowable material progressively through the bushing indentations, bushing collection manifolds, collection chamber, plate drainage channels, and drain, while consolidating the residual material in the compression chamber; and output means for expelling consolidated residual material from the compression chamber. In a preferred embodiment the block plates include a first aligned bore with a laterally opening plate mouth defining a precollection chamber; the liner includes bushings with a laterally opening bushing mouth defining a precompression chamber; and the input means comprise laterally actuated ram means for loading the precompression chamber with raw material with a gravity feed hopper with a lower loading chamber within which the ram means operates.

10 Claims, 7 Drawing Sheets

MATERIAL DENSIFYING AND SEPARATING DEVICE

TECHNICAL FIELD

The invention is directed to a device for separating a composite raw material under pressure into its constituent flowable and residual materials, and particularly a device having a laminated compression chamber block assembled of plates in a simple efficient design.

BACKGROUND OF THE ART

In the fields of waste processing, food preparation, scrap metal processing, pulp and paper manufacturing etc., a common challenge is to separate relatively soft or flowable material from relatively rigid hard residual material.

In metal processing for example, chips, shavings and other scrap metal are often produced contaminated by cutting oil. This contamination greatly reduces the price paid for such scrap due to the added steps required in removing oil prior to reuse of the metal. Conventional devices merely compress such scrap into compact cubes or cylindrical briquettes to reduce the bulk of shipping, however no prior art metal scrap densifying device recognizes the improvement in profitability that could result from a reduction in the oil content.

In pulp and paper manufacturing, fibrous pulp material is separated from water that is used in processing, bleaching, and conveying pulp. The incomplete removal of all fibrous material constitutes a water contamination problem and wastes fibers that could be utilized if recovered.

For example, U.S. Pat. No. 4,036,359 to Strictland describes a method of dewatering wood chips to form cube shaped compact bales by squeezing the chips with hydraulic rams in a compression chamber having perforated walls. U.S. Pat. No. 4,287,823 to Thompson describes a wood pulp baler and dewatering device that recovers pulp fibers by a similar straining process under pressure.

Such devices succeed in separating liquid from solid, however, the relatively low pressures which are used for soft wood chips and fibers are not sufficient to extract oil from scrap metal chips for example, or other high strength materials.

In waste processing, waste packaged foods are more efficiently disposed of when separated into waste food, which can be reprocessed into animal feed, and waste packaging, which can be recycled. Since the metal cans used for packaging constitute valuable scrap metal, the prior art waste processing devices have proposed recovery methods. For example, U.S. Pat. No. 5,230,917 to Peters describes lacerating cans, spraying with water to rinse away and reclaim the food and recovering the metal with a magnetic separator. This method results in a rather large expensive and complex machine that does not appear to be justifiable except where the volume of waste is very large. In most applications, disposal of waste in landfill dumps would likely remain the most economical choice.

In food processing, several applications require separation of materials. For example, in U.S. Pat. No. 4,230,733 to Tilby juice is extracted by applying axial pressure to pulp in a cylindrical chamber with an end screen, and in U.S. Pat. No. 4,536,920 to Amersfoort a filtering arrangement is used to extrude meat paste separating it from bone.

Again, in food processing, the pressures required fall far short of what is required to separate relatively high strength materials such as metal cans and food, or metal scrap and oil.

The design of the straining or filtering screens and supporting structures clearly do not contemplate high pressure operation and are thereby severely limited in scope.

It is desirable therefore to produce a device that can separate a composite raw material into constituent flowable and residual materials, but at extremely high pressures. Operation at high pressures allows application of such a device to wastes and processes that are inadequately addressed by complex or ineffective prior art methods.

DISCLOSURE OF THE INVENTION

The invention provides a novel device for separating a composite raw material under pressure into constituent flowable and residual materials. The device comprises: a laminated block having a longitudinal axis, the block comprising a plurality of transverse plates, each plate having: a first aligned bore defining an elongate collection chamber; a second aligned bore defining an elongate drain; and a transverse surface of each plate including a drainage channel extending between the first and second bores; an elongate perforated liner disposed within the collection chamber, the liner comprising a plurality of transverse planar bushings having an external surface bearing on an internal surface of the collection chamber, each bushing having: an internal aligned bore defining an elongate compression chamber; a groove in said external bushing surface defining a collection manifold between the collection chamber and each bushing; and a transverse surface of each bushing including a plurality of indentations extending between the internal bore and the collection manifold; input means for loading the compression chamber with said composite raw material; pressure means for pressurizing the raw material in the compression chamber urging said flowable material progressively through the bushing indentations, bushing collection manifolds, collection chamber, plate drainage channels, and drain, while consolidating the residual material in the compression chamber; and output means for expelling consolidated residual material from the compression chamber. In a preferred embodiment the block plates include a first aligned bore with a laterally opening plate mouth defining a precollection chamber; the liner includes bushings with a laterally opening bushing mouth defining a precompression chamber; and the input means comprise laterally actuated ram means for loading the precompression chamber with raw material with a gravity feed hopper with a lower loading chamber within which the ram means operates.

The laminated plate design of the liner and compression chamber block enables flexibility in design and relative ease of manufacture. The alternative of a solid cast and machined block is impractical and relatively expensive in comparison. Lamination allows the designer to tailor the size and shape of the block and compression chamber to suit the application with ease. Flame or plasma cut steel plate is relatively inexpensive, readily purchased and easily machined with commonly available machine tools.

The use of liner bushings and solid laminated block enable the compression chamber to withstand extremely high pressures in comparison to the designs of the prior art. Conventionally, the required resistance to force would be provided by one piece cast metal blocks which are extremely difficult to machine accurately and require specialized machinery. Use of a separate liner allows the operator the quickly change any worn or damaged liner parts, and enables users to quickly change the internal diameter of the compression chamber to adapt the device for different applications.

The use of a cylindrical compression chamber is preferred for high pressure applications since this shape offers the shortest radial extrusion path for the flowable material, homogeneous density of compressed material briquettes for the residual material and highest strength to weight ratio for the compression chamber block. Whereas compressed cubes of material have varying density between the core and the corners of the cube, a cylindrical briquette has uniform density throughout due to equal pressure distribution and radial migration of the compressed material. The cylindrical briquettes can be easily conveyed with convention equipment, compared to bulky strands or fibers, and can be completely contained within a cylindrical conduit for hazardous applications.

It has been found by experiment that when applied to machining chips, over 95% of the cutting oil can be removed from the metal scrap. A higher value is placed on such decontaminated and high density briquettes. In addition the cutting oil can be recovered and recycled.

When fibrous plastics are compressed under extremely high pressure, the fibers bond together in a dense mass reducing bulk and aiding in handling. When applied to waste canned food, substantially all of the food is extruded and recovered for reuse in animal feed, whereas the scrap metal is highly compressed and substantially decontaminated.

A major advance introduced by the invention is the ability to completely contain all materials. The input hopper may be enclosed with an air tight lid. The flowable material can be easily contained within piping and the residual material is formed into cylindrical briquettes that can be conducted through closed piping to contain hazardous materials. The entire device can be enclosed and operated under vacuum conditions to prevent the escape of toxic fumes. This feature is especially of interest in disposing of waste paint cans, military materials, explosive or flammable wastes in containers, or contaminated biological wastes for example.

The operation of the device can be fully automated and programmed with preselected settings for cycle timing, compression pressure and speed, input preparation and other variables. It is contemplated that computer programmable control and monitoring functions can be provided for remote access or by local touch screen operating.

The provision of computer numerical controls for the device enable the designer to preselect variables which have been found to be optimal, and preprogram such optimal settings to suit the application at hand. For example, a waste processing operator may encounter a large variety of different wastes, and it is most economical to handle all wastes with a single machine. The device can be provided with preprogrammed settings and a variety of liner bushings to handle the expected variety of waste applications.

Further details of the invention and its advantages will be apparent from the detailed description and drawings included below.

BRIEF DESCRIPTION OF THE DRAWINGS

In order that the invention may be readily understood, a preferred embodiment of the invention will be described by way of example, with reference to the accompanying drawings wherein.

DETAILED DESCRIPTION OF A PREFERRED EMBODIMENT

Figure 1:
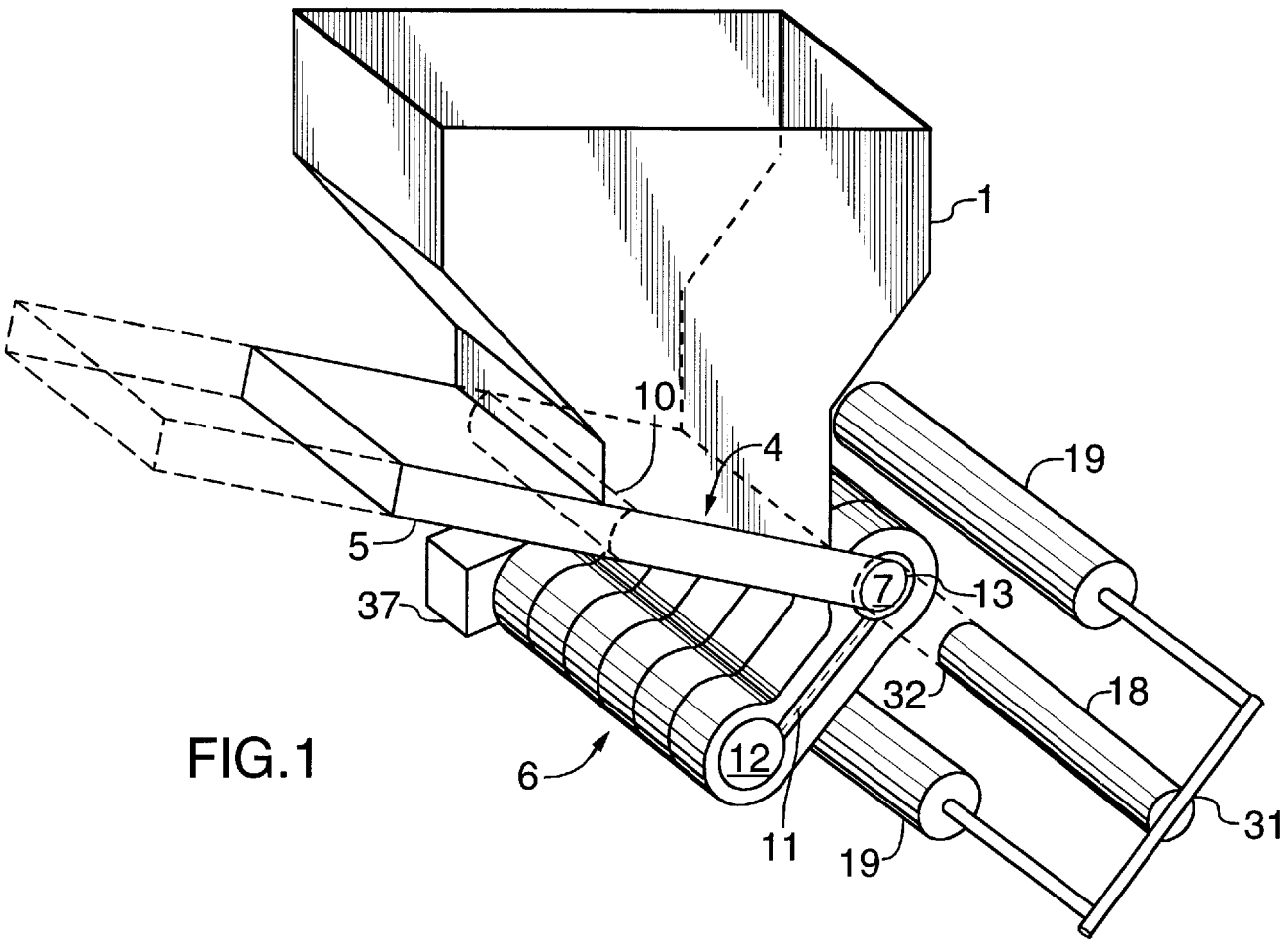
FIG. 1 is a schematic perspective view showing a gravity feed hopper with a laterally reciprocating loading ram loading a cylindrical precompression chamber in the block, and also showing the axially actuated piston which applies pressure to the raw material confined within the compression chamber.
Figure 2:
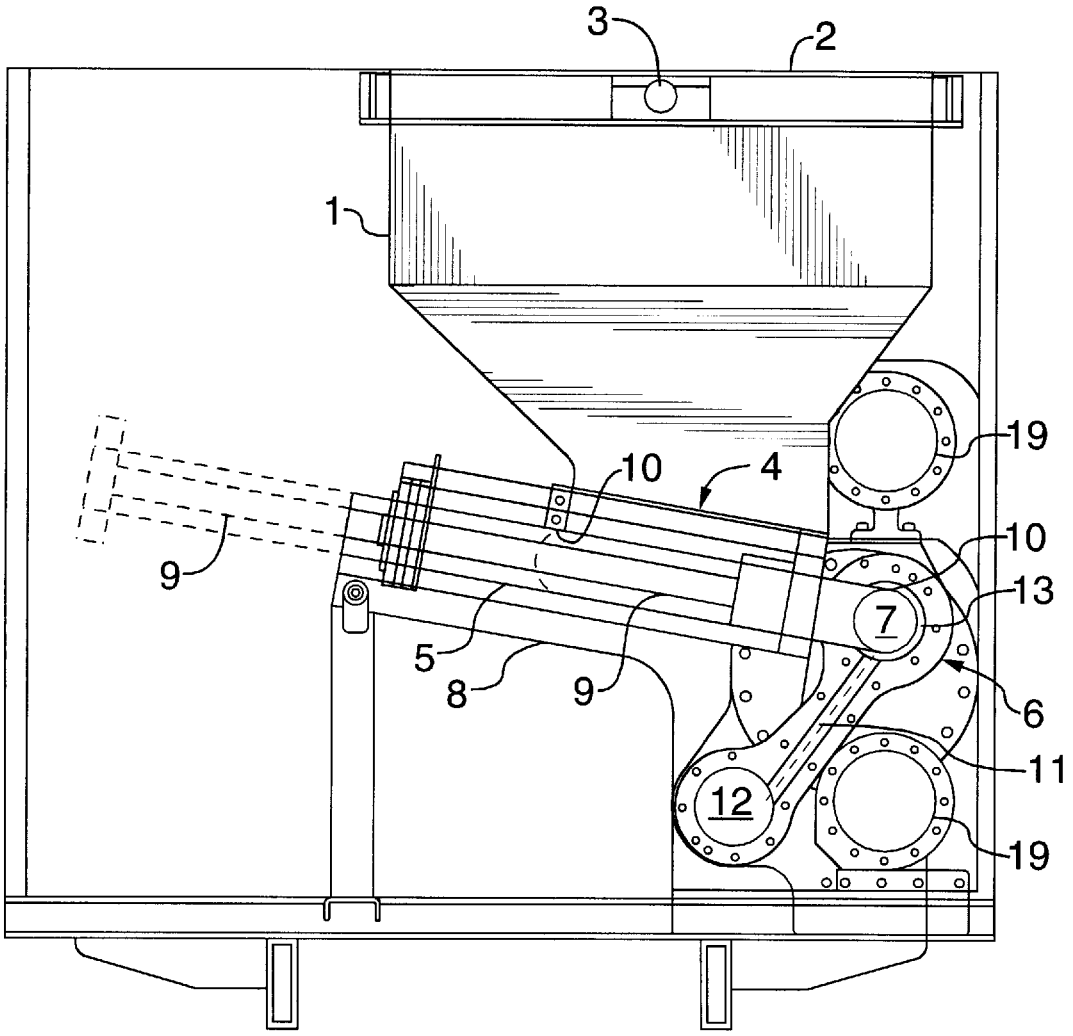
FIG. 2 is an end elevation view of the device showing the hopper, lateral reciprocating ram, dual hydraulic cylinders and block.
Figure 3:
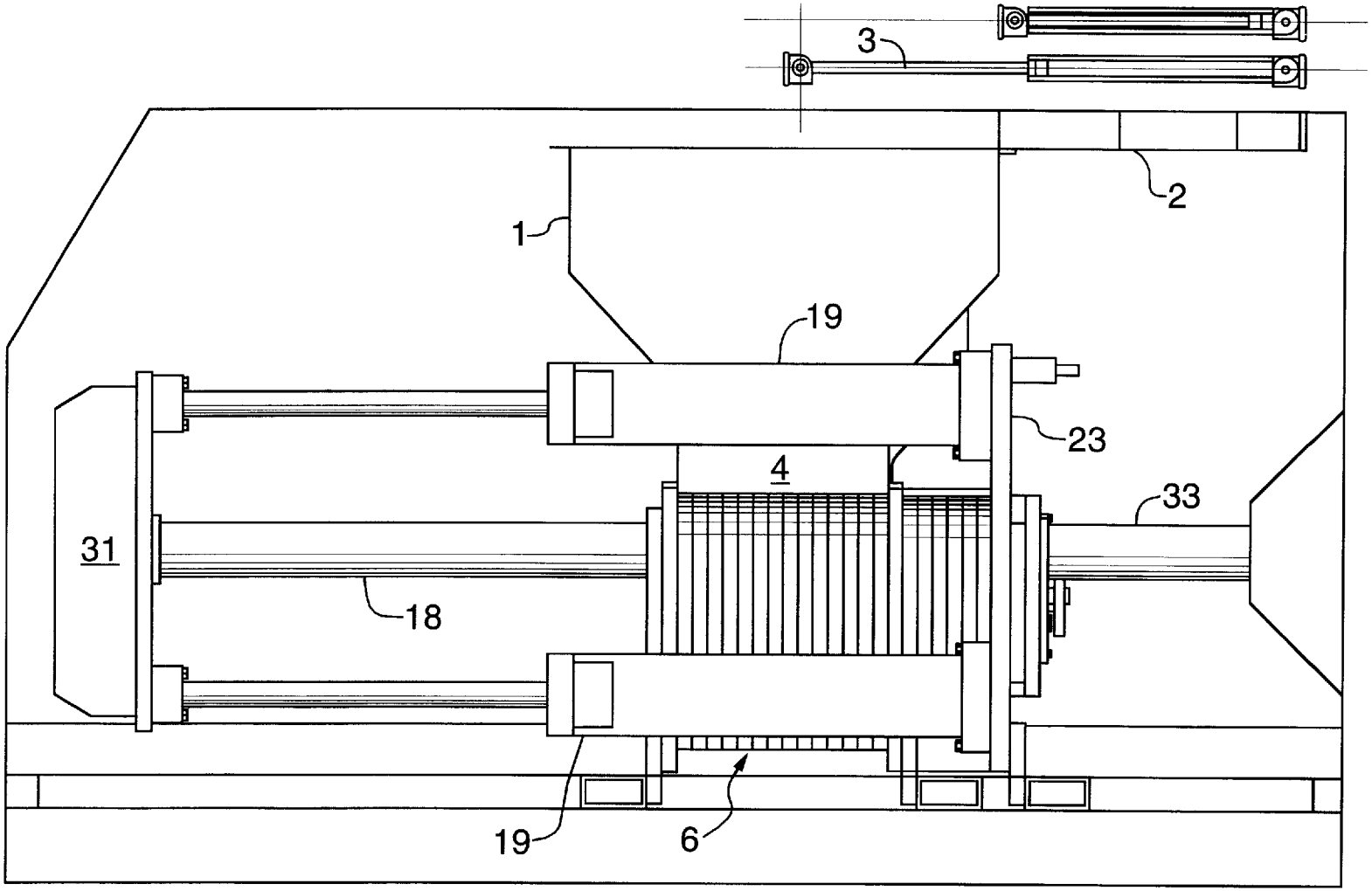
FIG. 3 is a side view showing in particular the laminated block and arrangement of the dual hydraulic compression cylinders which operate in reverse to pull the transverse yoke and parallel piston during compression and therefore recover more quickly extending to the left as drawn.

Referring to FIGS. 1–3, a preferred embodiment of the invention is illustrated in a form that would be applicable to processing bulky canned or packaged food waste as a raw material. In such an example, the relative volume of flowable food waste is large compared to the residual sheet metal packaging, a relatively large hopper is required to handle the bulk, and preliminary chopping or shearing of packaging is desirable to release as much of the food waste as possible from the packaging during precompression prior to final compression.

It will be understood that different raw materials require variations to the design for optimal performance and to accommodate different processed material properties. The invention in its broad scope encompasses not only the example described and illustrated herein, but also numerous applications wherein a composite raw material is to be separated under high pressure into its constituent flowable and residual materials, such as: separating machine cuttings and oil; separating pulp fibers from liquid; use in food processing; dewatering wood chips or peat; and other applications.

The features of the device and its operation are as follows. Composite raw material is deposited into a gravity feed hopper 1, by conveyor, fork lift or front end loader. The open top of the hopper may be closed with a lid 2, actuated by hydraulic cylinders 3, to contain the raw material. For example, if aerosol containers are to be disposed of, the lid can contain flying debris caused by compression. If desired the lid 2 may be made airtight with gaskets, and the hopper 1 may be operated under vacuum to contain flammable or toxic fumes emitted by the waste. The entire machine can be purged with inert gas as well.

The bottom end of the hopper tapers to define a lower loading chamber 4. A reciprocating sliding ram 5 operates within the loading chamber 4 to laterally feed or input raw material into the precompression chamber 7 of the block 6 (to be described in detail below).

The block 6 includes laterally extending support brackets 8 (also described in detail below) on both sides of the ram 5 to support the hopper 1, ram 5 and dual hydraulic cylinders 9 which actuate the ram 5.

In the example illustrated, the precompression chamber 7 has a cylindrical bore and the ram 5 has a concave forward face, that when fully advanced completes the cylindrical precompression chamber 7. Also in order to shear open containers or chop the raw material, an edge of the forward face of the ram 7 includes a cutting blade 10 which coacts with a hardened cutting edge on a rearward edge of the precompression chamber 7.

Initial precompression and chopping of the raw material occurs as the ram 5, actuated by retraction of the hydraulic cylinders 9, pushes raw material from the hopper loading chamber 4 into the cylindrical precompression chamber 7. The raw material is sheared by the front cutting blade 10 of the ram 5 and squeezed into a cylindrical shape in the precompression chamber 7.

The primary function of the precompression step as a first stage is to reduce the bulk or volume of the waste raw material and to prepare a cylindrical slug in the precompression chamber 7 for high pressure second stage compression in a cylindrical compression chamber in the block 6 downstream of the precompression chamber 7. The difference between the precompression chamber 7 and the compression chamber resides in the laterally open side mouth in the precompression chamber 7. The compression chamber is a completely enclosed cylinder. The precompression chamber 7 is laterally open to the loading chamber 4 and is completed as a closed cylinder when the ram 5 with its convex front face is fully advanced.

The raw material may have a significant void ratio due to large irregularly shaped pieces, or may contain fluids or readily flowable constituent material. During chopping and precompression, such flowable material is removed through drainage channels 11 and an elongate drain 12 in the block 6, via gravity flow, optionally under vacuum and as a result of the lateral pressure applied by the ram 5.

The precompression chamber 7 and compression chamber are lined with an elongate perforated liner 13. The liner 13 allows the flowable material to flow through the perforations and retains the residual material within the liner 13. The liner 13 is preferably cylindrical within the second stage compression chamber and has a laterally open mouth in the first stage precompression chamber. Of course if desired the precompression, compression chamber and liner 13 can be designed to produce rectangular briquettes or other shapes, however due to the desire for uniform density and to provide the shortest radial migration route for flowable material, a cylindrical shape is preferred.

Figure 4:
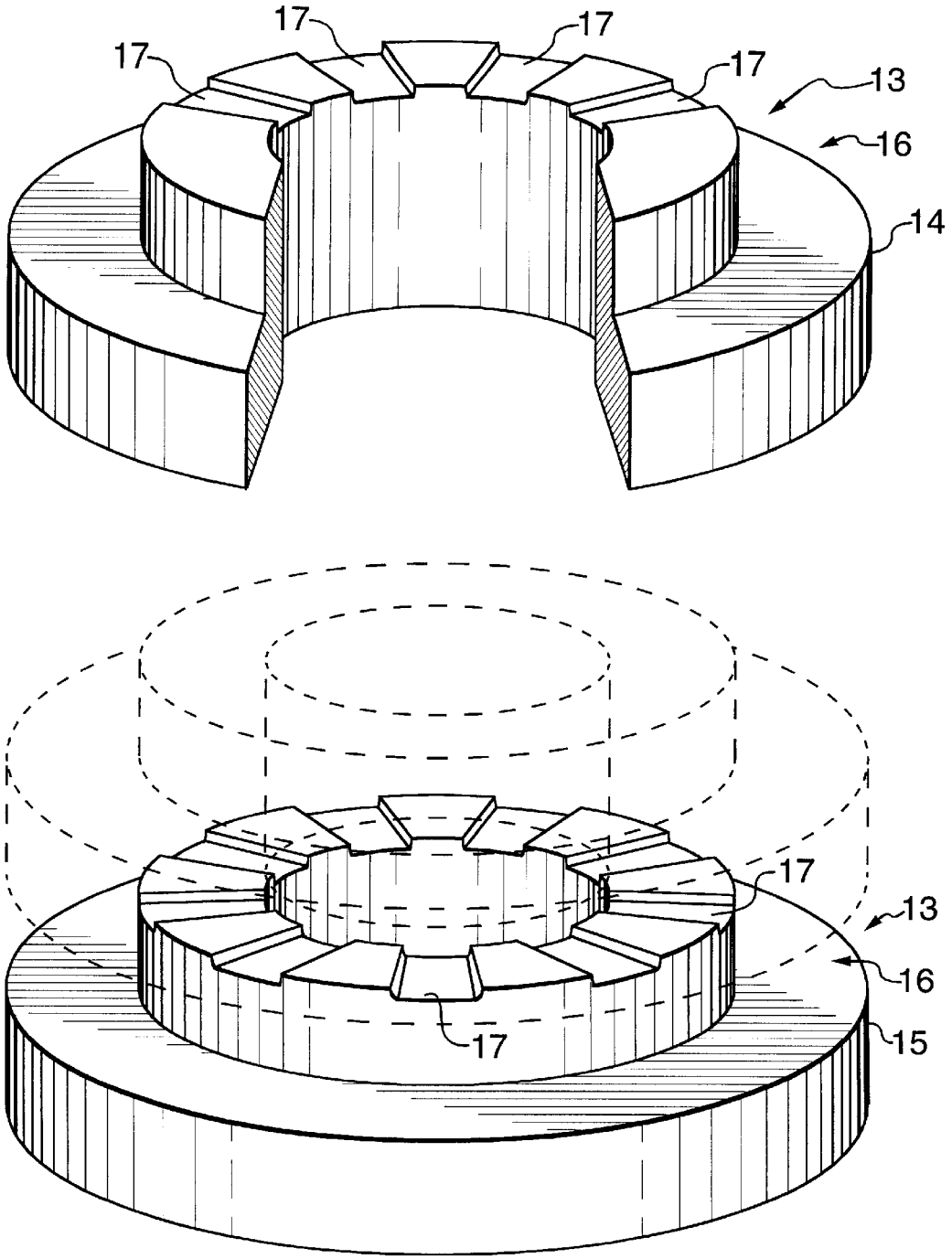
FIG. 4 is a detail perspective view of the liner bushings illustrating radial indentations allowing flowable material to progress to the annular collection manifold defined by an annular exterior groove.

Referring to FIG. 4, the liner 13 is assembled of a number of annular bushings having an external cylindrical surface bearing on an internal cylindrical surface of a collection chamber in the block 6. The precompression chamber 7 liner 13 is assembled of open mouthed bushings 14 whereas the compression chamber liner 13 is lined with closed annular bushings 15. In both cases all other features of the bushings 14, 15 are identical. The internal bore of the bushings 14, 15 are aligned to define the axially aligned precompression and compression chambers respectively. A circumferential groove 16 in the external bushing surface defines a collection manifold for flowable material moving under pressure from the internal bore of the bushing 14, 15 through indentations 17 in the transverse bushing surfaces.

Once the ram 5 has been fully advanced, a cylindrical slug of partially compressed raw material is housed in the precompression chamber 7. The second stage of the compression is then commenced while the ram 5 is held in the fully advanced position shown in FIGS. 1–2. Dual hydraulic cylinders 19 operably connected drive a cylindrical piston 18 to a transverse yoke 31. As the hydraulic cylinders 19 are reversed or retracted, an inner end 32 of the piston 18 slides axially within the precompression chamber 7 then within the compression chamber. The extremely high pressure within the compression chamber exudes virtually all of the flowable material through the liner 13 to the drain 12 and also highly compresses the residual material into a dense cylindrical briquette.

The disposition of the main hydraulic cylinders 19 and the ram actuating cylinders 9 are reversed from standard orientation. Although the force capacity in reverse is less than the capacity in forward orientation (due to the reduction in surface area caused by the cylinder rod), this disadvantage is more than compensated for by several advantages resulting from the reverse orientation. Reverse orientation enables the compact nesting of the main hydraulic cylinders 19 on both sides of the block 6 to reduce the overall size of the device. As well the reverse orientation allows for a rapid withdrawal of the piston 18 using a regenerative hydraulic circuit thereby increasing the speed of operation. This eliminates the need for a separate low pressure high volume hydraulic fluid pump.

Figure 5:
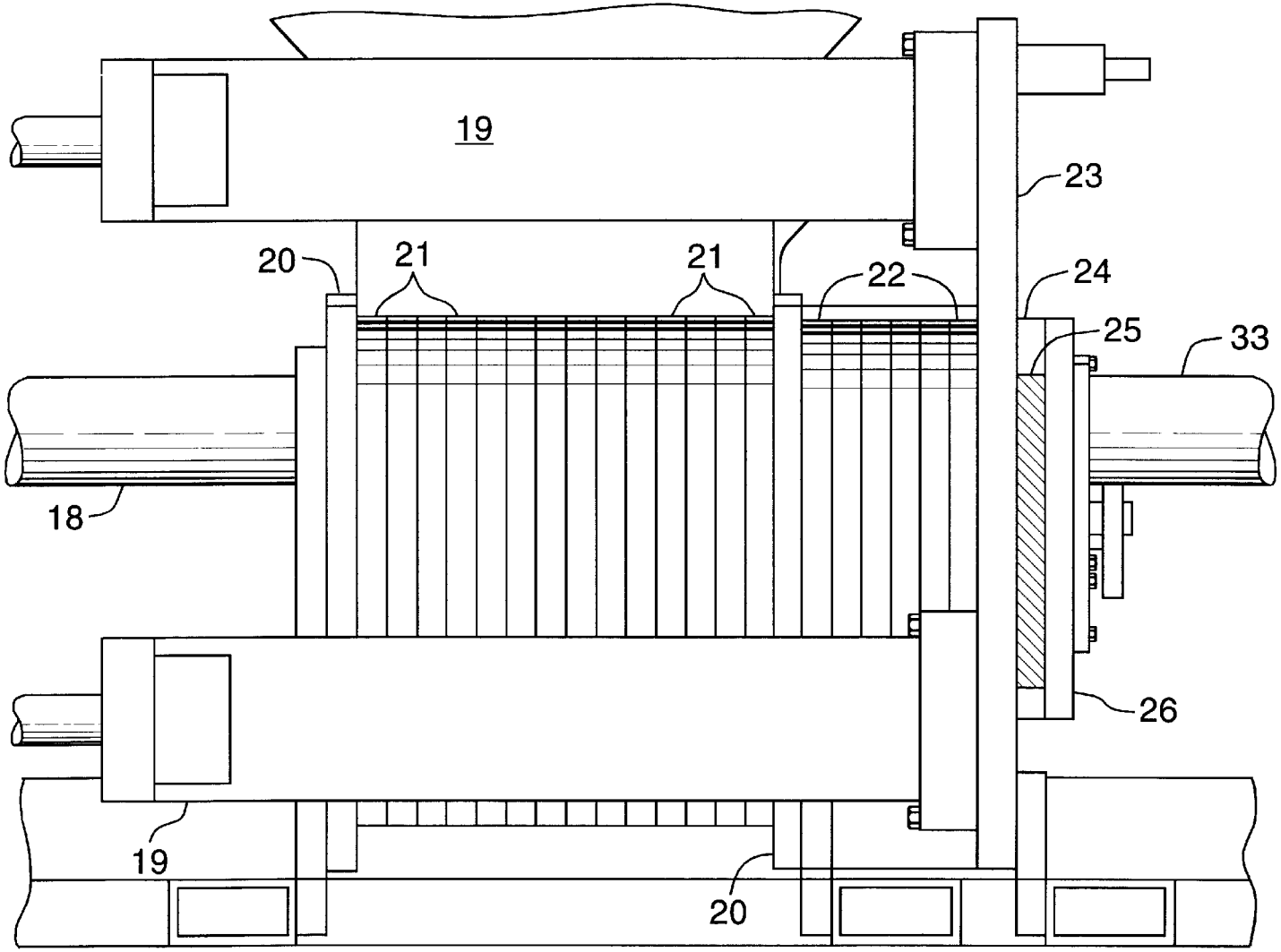
FIG. 5 is a detail side elevation view of the laminated block with rotary gate drawn to the right admitting spent residual material into the output conduit under compression exerted by the piston acting from left to right as drawn.
Figure 7:
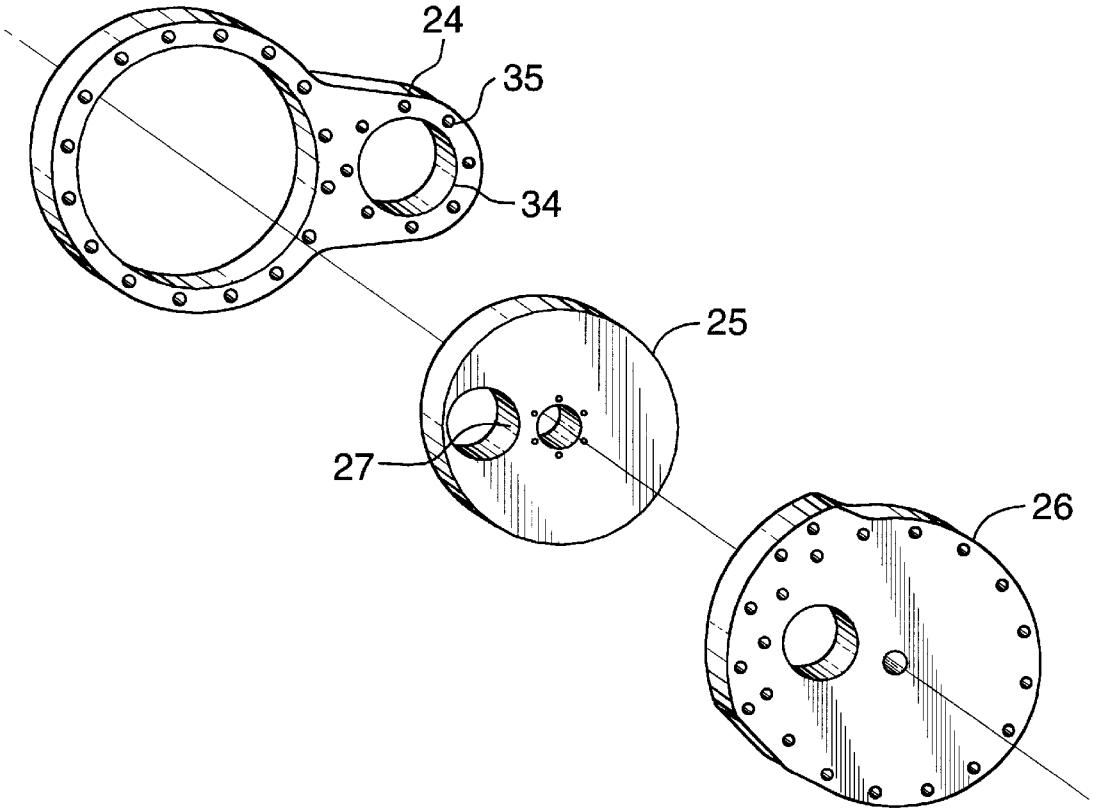
FIG. 7 is an exploded perspective view of the rotary gate components that selectively close the end of the compression chamber during compression, and open to allow the piston to expel a cylindrical briquette of spent residual material.

The rearward end of the compression chamber is closed during loading, precompression and compression to provide axial resistance to the axial pressure applied by the piston 18. A rotary gate 25, shown in FIG. 7, is used to selectively close the rearward end of the compression chamber and on conclusion of compression, to open the rearward end and allow the briquette to pass through the gate orifice 27 as the piston 18 is extended. As best shown in FIG. 5, the gate end plate 26 of the gate is connected to an output conduit 33.

In simple applications, the output conduit 33 will eject compressed briquettes into a disposal container, however it will be appreciated that when handling hazardous materials, the output conduit 33 can be used to completely contain residual material for further processing downstream or to feed a packaging machine for example. The drain 12 can also be connected to a disposal drain conduit outside the block to completely contain and remove the flowable material. Communication between the raw material, flowable and residual material during operation can be completely eliminated by containing the hopper 1 with a lid 2, conveying the flowable material in a conduit from the drain 12, and containing the residual material in briquettes conveyed within a discharge conduit 33. Complete containment is advantageous in containing hazardous materials and makes the cleaning of the device simpler than prior art devices.

Figure 6:
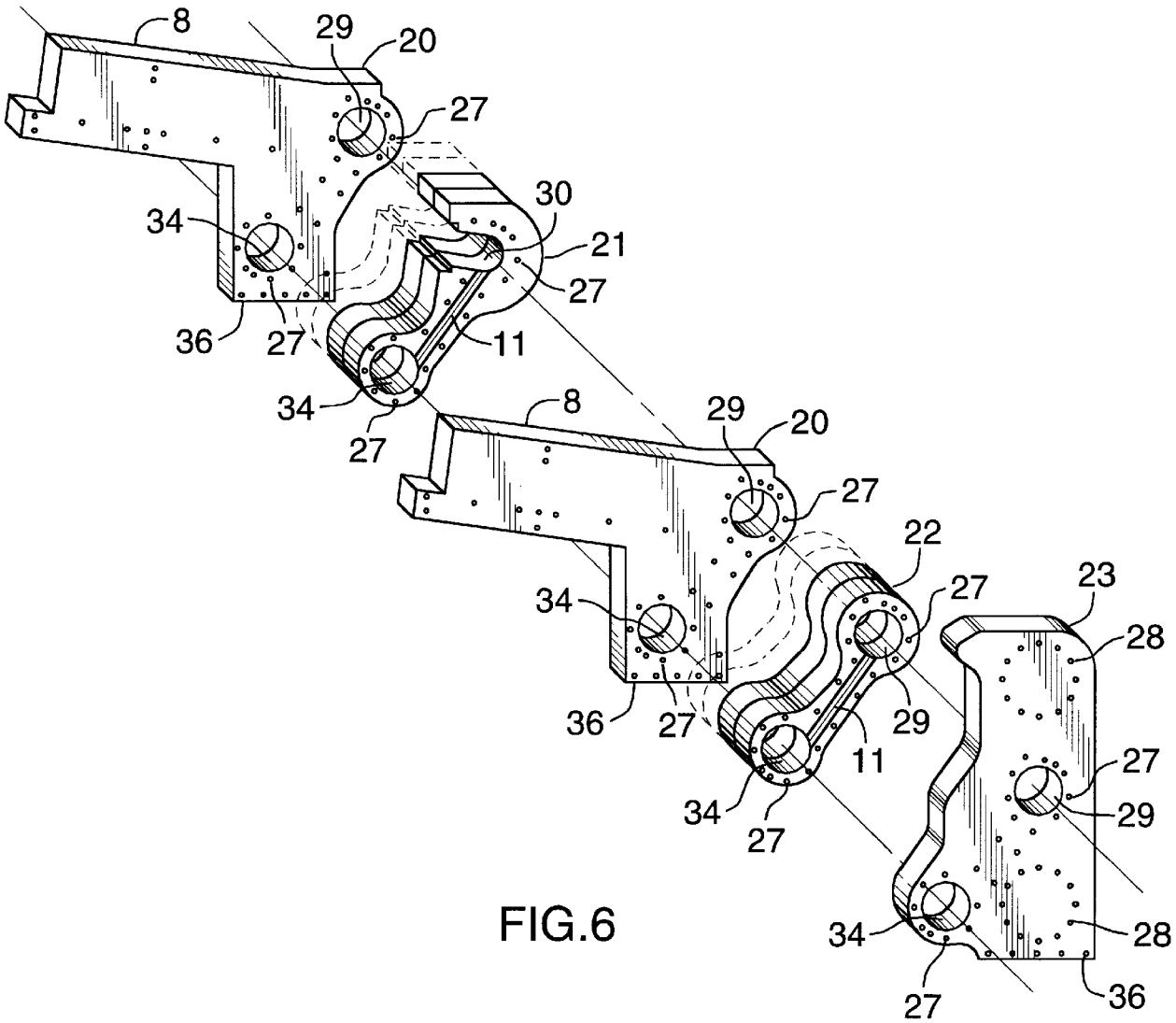
FIG. 6 is an exploded perspective view of the components of the block showing how various plates can be assembled to defined lateral ram supports, open mouthed precompression chamber, compression chamber and cylinder end supports utilizing the flexibility of the laminated design.

The construction of the block 6 can be best seen in the exploded view of FIG. 6 with reference to the assembled block 6 detail of FIG. 5. The block 6 has a longitudinal axis and is assembled from a series of flat plates 20–23. The plates 20–23 include alignment holes 27 through which long bolts are extended to tie the assembly together into a rigid block 6.

The block end plate 23 includes mounting holes 28 to mount the ends of the large hydraulic cylinders 19 that drive the piston 18 as best seen in FIGS. 3 and 5. The compression chamber plates 22 have a completely enclosed cylindrical bore 29, as do the end plate 23 and bracket plates 20. The precompression plates 21 include a bore 30 with a laterally open mouth. The bores 29 and 30 are axially aligned in the assembled block 6 to define the cylindrical precollection and collection chambers which house the liner bushings 14, 15 to form the precompression and compression chambers.

In a like manner all plates 20–23 include a second transverse aligned bore 34 to define the elongate drain 12 through the block 6. The gate housing plate 24 mounted to the block end plate 23 also includes an aligned bore 34 and flange mounting holes 35 to which a flanged drain conduit may be connected.

In at least the precompression plates 21 and the compression plates 22 there are drainage channels 11 extending between the first bore 29,30 and the second bore 34. When the flat plates are assembled together, the channels 11 are bounded between the plates and all abutting surfaces are sealed with gaskets or caulking.

The advantages of such an assembly of flat plates are many. A solid metal block 6 assembled of flat plates 20–23 capable of resisting the extremely high internal pressure exerted by the piston 18 can be economically machined and assembled with commonly available machine tools. In contrast, a cast block is difficult to machine and handle, and requires large specialized machinery to complete the bores. If drainage channels are drilled into a cast block, the operation is relatively high cost and time consuming in comparison to machining channels 11 in the face of a flat plate. The designer can easily vary the configuration of flame or plasma cut plates whereas redesigning a cast block would result in inefficiencies if the casting moulds are not repeatedly used. Repair and maintenance are simplified since a damaged or scored plate can be replaced or re-machined easily compared to repairing the complete block. As in the case of the bracket plates 20, various support brackets 8 or cylinder supports 28 in the block end plate 23 can be easily provided by extending the plates during design modifications for specific applications. The base of bracket plates 20 also can be extended to provide mounting holes 36 a flat mounting surface, which as in FIG. 5, can be utilized to package the device within a palletized container for ease of transport and cleaning.

It will be apparent that different composite materials must be processed differently through the device. In some cases various modifications to liner 13 and plate 20–23 configuration may be needed to optimize the design. For example where the ratio of flowable material volume to residual material volume is high, the size of the collection chamber 29 and drain 12 may be increased. However, without changing the physical properties of the device, various modifications to the operating conditions can also optimize the device for processing different raw materials. For example, the pressure, number of cycles and speed of the main hydraulic cylinders 19 and ram cylinders 9 may be varied. To process oil covered scrap metal an extremely high pressure is required, whereas to process pulp waste a slowly applied pressure is optimal.

The invention preferably includes programmable control means such as a computer with touch screen interface, to selectively control the parameters of operation. Through experiment, various combinations of control settings can be generated and stored enabling the device to be quickly adapted for processing different materials. Parameters which can be easily controlled in this manner include: main cylinder 19 pressure and cycle speed; ram 5 pressure and speed; drain 12 vacuum; hopper 1 feeding and lid 2 operation.

Therefore to summarize, the device provides a novel laminated block 6 assembled from a plurality of transverse plates 20–23. Each compression chamber plate 22 has: a first aligned transverse bore 29 defining an elongate collection chamber; a second aligned transverse bore 34 defining an elongate drain 12; and a transverse surface of each plate 22 including a drainage channel 11 extending between the first and second bores.

An elongate perforated liner 13 is disposed within the collection chamber of the block 6. The liner 13 comprises a plurality of transverse planar bushings 15 having an external surface bearing on an internal surface of the collection chamber. Each bushing 15 has: an internal aligned bore defining an elongate compression chamber; a groove 16 in the external bushing surface defining a collection manifold between the collection chamber and each bushing 15 and a transverse surface of each bushing 15 including a plurality of indentations 17 extending between the internal bore and the collection manifold 16.

Input means are provided for loading the compression chamber with composite raw material. In the case illustrated, input means include a gravity feed hopper 1 with a lower loading chamber 4 within which a ram 5 operates to laterally feed and precompress raw material. Depending on the raw material, it may not be necessary or desirable to precompress the raw material, for example in the case of pulp. Where required, each precompression plate 21 also includes a first aligned bore 30 with a laterally opening plate mouth defining a precollection chamber. The liner 13 includes bushings 14 with a laterally opening bushing mouth defining a precompression chamber 7.

Pressure means are provided for pressurizing the raw material in the compression chamber urging the flowable material progressively through the bushing indentations 17, bushing collection manifolds 16, collection chamber (defined by bores 29), plate drainage channels 11, and drain 12, while consolidating the residual material in the compression chamber. The pressure means comprise an axially actuated piston 18 with an inner end 32 slidably disposed within the compression chamber, a transverse yoke 31 disposed at an outer end of the piston 18, and two hydraulic cylinders 19 operably connected to the yoke 31 and parallel the piston 18, the cylinders 19 retracting during a compression stage of their cycle and extending during a recovery stage. If desired the pressure means may include a vacuum unit 37 communicating with the drain 12 for withdrawing the flowable material from the compression chamber through the liner 13.

Output means such as an end rotary gate 25 serve to expel the consolidated residual material from the compression chamber through a conduit 33.

Although the above description and accompanying drawings relate to specific preferred embodiments as presently contemplated by the inventor, it will be understood that the invention in its broad aspect includes mechanical and functional equivalents of the elements described and illustrated.

I claim:

1. A device for separating a composite raw material under pressure into constituent flowable and residual materials, the device comprising:

a laminated block having a longitudinal axis, the block comprising a plurality of transverse plates, each plate having: a first aligned transverse bore defining an elongate collection chamber; a second aligned transverse bore defining an elongate drain; and a transverse surface of each plate including a drainage channel extending between the first and second bores;

an elongate perforated liner disposed within the collection chamber, the liner comprising a plurality of transverse planar bushings having an external surface bearing on an internal surface of the collection chamber, each bushing having: an internal aligned bore defining an elongate compression chamber; a groove in said external bushing surface defining a collection manifold between the collection chamber and each bushing; and a transverse surface of each bushing including a plurality of indentations extending between the internal bore and the collection manifold;

input means for loading the compression chamber with said composite raw material;

pressure means for pressurizing the raw material in the compression chamber urging said flowable material progressively through the bushing indentations, bushing collection manifolds, collection chamber, plate drainage channels, and drain, while consolidating the residual material in the compression chamber; and output means for expelling consolidated residual material from the compression chamber.

2. A device according to claim 1 wherein:

the block plates include a first aligned bore with a laterally opening plate mouth defining a precollection chamber;

the liner includes bushings with a laterally opening bushing mouth defining a precompression chamber; and the input means comprise laterally actuated ram means for loading the precompression chamber with the raw material.

3. A device according to claim 2 wherein the input means comprises a gravity feed hopper with a lower loading chamber within which the ram means operates.

4. A device according to claim 2 wherein the ram means comprise a cutting blade.

5. A device according to claim 1 wherein the pressure means comprise an axially actuated piston an inner end slidably disposed within the compression chamber, a transverse yoke disposed at an outer end of the piston, and two hydraulic cylinders operably connected to the yoke and parallel the piston, the cylinders retracting during a compression stage of their cycle and extending during a recovery stage.

6. A device according to claim 1 wherein the pressure means comprise vacuum means for withdrawing the flowable material from the compression chamber through the liner.

7. A device according to claim 1 wherein the output means include a rotary gate disposed at an output end of the compression chamber.

8. A device according to claim 7 wherein the output means further comprise an output conduit downstream of the rotary gate.

9. A device according to claim 1 further comprising means for containing the raw material, flowable and residual material from communication with adjacent environments during operation.

10. A device according to claim 1 further comprising programmable control means for selectively controlling parameters of operation.

* * * * *